US005638727A

United States Patent [19]

Gringer

[11] Patent Number: 5,638,727

[45] Date of Patent: Jun. 17, 1997

[54] PLASTIC SCREWDRIVER WITH RETAINING RING

[75] Inventor: Donald Gringer, New York, N.Y.

[73] Assignee: Allway Tools, Inc., Bronx, N.Y.

[21] Appl. No.: 567,156

[22] Filed: Dec. 5, 1995

Related U.S. Application Data

[63] Continuation-in-part of Ser. No. 381,753, Feb. 1, 1995, abandoned.

[51] Int. Cl.[6] ..... B25B 23/00

[52] U.S. Cl. ..... 81/438; 81/177.4; 81/900

[58] Field of Search ..... 81/437–439, 177.4, 81/490, 121.1, 492, 900

[56] References Cited

U.S. PATENT DOCUMENTS

| | | | |
|---|---|---|---|
| D. 351,547 | 10/1994 | Herrala . | |
| 1,212,430 | 1/1917 | West | 81/490 |
| 2,288,093 | 6/1942 | Kaffenberger et al. . | |
| 3,604,486 | 9/1971 | Henry . | |
| 3,604,488 | 9/1971 | Wishart et al. . | |
| 3,613,751 | 10/1971 | Juhasz . | |
| 3,674,070 | 7/1972 | Mahoney . | |
| 3,683,984 | 8/1972 | Hull . | |
| 3,739,825 | 6/1973 | Knox . | |
| 3,752,202 | 8/1973 | Condon . | |
| 3,842,875 | 10/1974 | Tascone . | |
| 3,884,282 | 5/1975 | Dobrosielski . | |
| 3,985,170 | 10/1976 | Iskra . | |
| 4,122,569 | 10/1978 | Hitchcock . | |
| 4,190,091 | 2/1980 | Colognori . | |
| 4,209,182 | 6/1980 | Sheldon . | |
| 4,227,430 | 10/1980 | Jansson et al. . | |
| 4,328,721 | 5/1982 | Massari . | |
| 4,429,599 | 2/1984 | LaSante, Sr. . | |
| 4,434,688 | 3/1984 | Bowles . | |
| 4,434,828 | 3/1984 | Trincia . | |
| 4,449,559 | 5/1984 | Martinmaas . | |
| 4,463,788 | 8/1984 | Corona et al. . | |
| 4,488,462 | 12/1984 | Wall . | |
| 4,552,043 | 11/1985 | Corona et al. . | |
| 4,552,044 | 11/1985 | Corona et al. . | |
| 4,629,375 | 12/1986 | Lieser . | |
| 4,640,155 | 2/1987 | Condon . | |
| 4,653,356 | 3/1987 | Golden . | |
| 4,674,367 | 6/1987 | Aab et al. . | |
| 4,680,995 | 7/1987 | LaRue . | |
| 4,716,795 | 1/1988 | Corona et al. . | |
| 4,741,059 | 5/1988 | Lee et al. . | |
| 4,762,035 | 8/1988 | Fushiya et al. . | |
| 4,766,783 | 8/1988 | Stanich et al. . | |
| 4,777,852 | 10/1988 | Herman et al. . | |
| 4,803,904 | 2/1989 | Stanich et al. . | |
| 4,916,988 | 4/1990 | Robertson et al . . | |
| 4,924,733 | 5/1990 | McKenzie . | |
| 4,954,026 | 9/1990 | Zurwelle . | |

(List continued on next page.)

FOREIGN PATENT DOCUMENTS

| | | |
|---|---|---|
| 3004958 | 8/1981 | Germany . |

*Primary Examiner*—D. S. Meislin

*Attorney, Agent, or Firm*—David M. Klein; Bryan Cave LLP

[57] ABSTRACT

A hand-held driver for use with removable driving bits, such as screwdriver or nut-driver bits, is disclosed. The driver includes a handle adapted to be hand-held, and a shaft. The shaft has a proximal end secured to the handle, and a distal end with a recess sized and shaped to enable a driving bit to be insertable therein and removable therefrom with a driving end of the driving bit extending from the shaft. A retaining ring circumferentially surrounds the shaft toward the distal end and is closely sized thereto. The retaining ring has an open end adjacent to the distal end that has a size and shape corresponding to the recess in the shaft. The retaining ring enables the shaft of the driver to be constructed of lesser strength materials. The handle and shaft are constructed of a thermoplastic, and are preferably integrally constructed. The retaining ring is constructed of stainless steel or another high tensile strength material. A handle for the driver includes one or more bit-receiving slots. Each slot includes resilient means integrally molded with the handle for providing frictional resistance to movement of the bit within the slot.

13 Claims, 10 Drawing Sheets

U.S. PATENT DOCUMENTS 4,979,355 12/1990 Ulevich ..... 81/121.1
5,056,387 10/1991 Cook .
5,230,261 7/1993 Akazawa et al. ..... 81/177.4 X
5,251,352 10/1993 Cullison .
5,263,389 11/1993 Frazzell et al. .
5,269,208 12/1993 Kolvites et al. ..... 81/121.1 X
5,285,543 2/1994 Rowe .
5,325,745 7/1994 Koehler .
5,335,409 8/1994 Elvebak .
5,345,636 9/1994 Lamons .
5,351,586 10/1994 Habermehl et al. .
5,359,911 11/1994 Kruesi .

PLASTIC SCREWDRIVER WITH RETAINING RING

CROSS-REFERENCE TO RELATED APPLICATION

This is a continuation-in-part application of commonly owned U.S. application Ser. No. 08/381,753, filed Feb. 1, 1995, now abandoned the content of which is incorporated herein by reference.

BACKGROUND OF THE INVENTION

1. Field of the Invention

The present invention relates generally to a driver for screws or other fasteners, and more particularly to a hand-held driver which has a plastic shaft for receiving driving bits. The shaft includes a retaining ring adjacent to the bit receiving end. The handle includes bit holding slots having integral retention means for the bits.

2. Description of the Related Art

Devices for driving screws and the like are well known in the art, and have changed very little throughout the years. The typical driver, i.e., a screwdriver or nut driver, includes a handle, which is often made of plastic, and a metal shaft which extends from the handle. The shaft has a relatively small diameter so that the driver may be used in areas with limited access. The end of the shaft distal from the handle includes a hexagonal recess for receiving conventional driving bits. These types of bits are hexagonal on one end for being received by the driver, and include a driving end for installation and removal of the fastener to which the driving end corresponds. The driving bit may be, for example, a slotted, phillips or torx screwdriver, or a nut-driver bit.

Hand-held drivers of this type are shown, for example, in U.S. Pat. Nos. 4,227,430 and 4,924,733. The driving end of these types of drivers is subject to high torque forces. Thus, none of the drivers of this type employ a plastic or other nonmetallic shaft, since the torque at the driving end would likely cause premature failure of the shaft which would result in the bit stripping or cracking the shaft. This necessitates the use of a plastic handle with a metallic shaft and the increased cost of manufacture associated therewith.

U.S. Pat. No. 5,263,389 relates to a marine propeller wrench constructed of a plastic material impregnated with glass fibers. An annular reinforcing ring provides additional hoop strength to the socket portion. This device is constructed of relatively expensive materials to provide the necessary strength for a wrench, and as such is not practical for a mass-produced driver.

Drivers having handles for storing bits are also well known in the art. Such devices are shown, for example, in U.S. Pat. Nos. 3,683,984; 4,227,430; 4,434,828; 4,716,795; 4,924,733; 5,325,745; and 5,335,409. In these types of drivers, the handle of the driver typically includes several slots in which the driving bits are inserted. Retention means is provided for holding the driving bits within the slots. For example, in U.S. Pat. No. 4,434,828, sleeves of resilient material are press-fit into openings in the handle. U.S. Pat. No. 5,325,745 employs leaf springs which are used to hold the bits in the slots. U.S. Pat. No. 3,683,984 employs another type of spring to hold the bits in the slots. In U.S. Pat. No. 4,227,430, a portion of the handle may be rotated to expose the bits, which are stored within the handle. Finally, in U.S. Pat. No. 4,924,733, another type of spring mechanism is utilized.

In those patents in which a spring is utilized to hold the bit within each slot, the spring is a separate element from the handle. This increases the cost and complexity of manufacturing these drivers.

SUMMARY OF THE INVENTION

The present invention is a driver, preferably a hand-held driver, for use with removable driving bits, such as screwdriver or nut-driver bits. The driver includes a handle adapted to be hand-held, and a shaft. The shaft has a proximal end secured to the handle, and a distal end comprising a recess sized and shaped to enable a driving bit to be insertable therein and removable therefrom with a driving end of the driving bit extending from the shaft. A retaining ring (or ferrule) circumferentially surrounds the shaft toward the distal end and is closely sized thereto. The retaining ring has an open end adjacent to the distal end of the shaft having a size and shape corresponding to and aligned with the recess. The retaining ring (or ferrule) enables the shaft of the driver to be constructed of considerably weaker materials than was previously possible.

The handle and shaft are preferably each constructed of a thermoplastic, and are integrally constructed. The retaining ring is preferably constructed of stainless steel or another strong material.

Also disclosed is a handle for a driver, that includes one or more bit-receiving slots. Each slot is sized for enabling a driving bit to be slidably insertable therein and removable therefrom. Each slot includes resilient means integrally molded with the handle for providing frictional resistance to movement of the bit within the slot. This prevents the bit from falling out of the slot while still enabling insertion and removal of the bit from the slot. In one embodiment, the handle includes first and second portions adapted to be separably fitted together, the first portion attaching the handle to the shaft, the second portion incorporating the bit-receiving slots. In this embodiment, the handle and shaft are each constructed of a thermoplastic, and the first portion of the handle and the shaft are integrally constructed.

The resilient means is preferably either: A resilient arm which extends at least partially into the slot, whereby the resilient arm is laterally biased against a bit which is inserted into the slot; a resilient lip which applies frictional pressure to a bit inserted into the slot; or a resilient arm and a nub on the resilient arm that extends into the slot, wherein the resilient arm returns to a relaxed position after the insertion or removal of a bit.

More broadly, the invention may be embodied in any device which removably receives driving bits. The shaft has a first end for connection to a drive means for causing rotation of the shaft, and a second end distal from the first end which comprises a recess sized and shaped to enable the driving bits to be insertable therein and removable therefrom. The retaining ring circumferentially surrounds the shaft toward the second end and is closely sized to the outer diameter thereof.

The use of the retaining ring enables the shaft to be made of a plastic material and still have a diameter which is practical for use in areas with limited access.

DESCRIPTION OF THE PREFERRED EMBODIMENT

Figure 2:
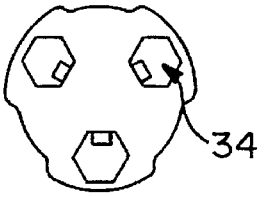
FIG. 2 is a top view of the hand-held driver shown in FIG. 1.
Figure 1:
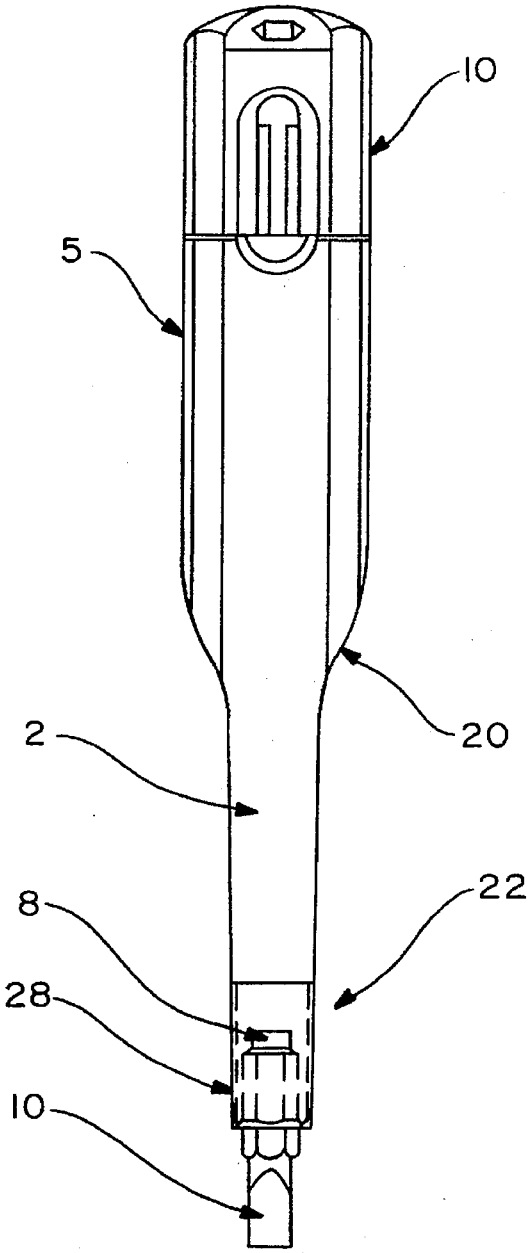
FIG. 1 is a side view of a hand-held driver according to the present invention.
Figure 4:
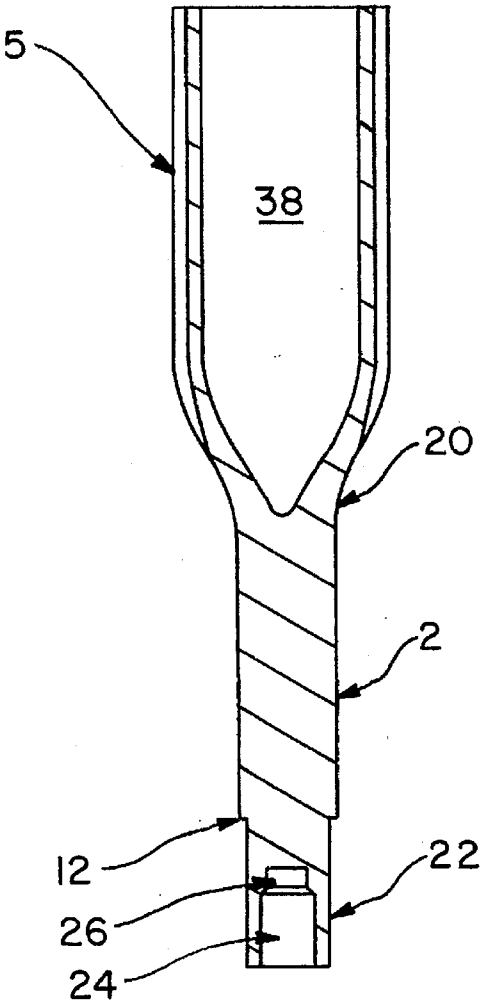
FIG. 4 is a cross-sectional side view through Section D—D of FIG. 10
Figure 3:
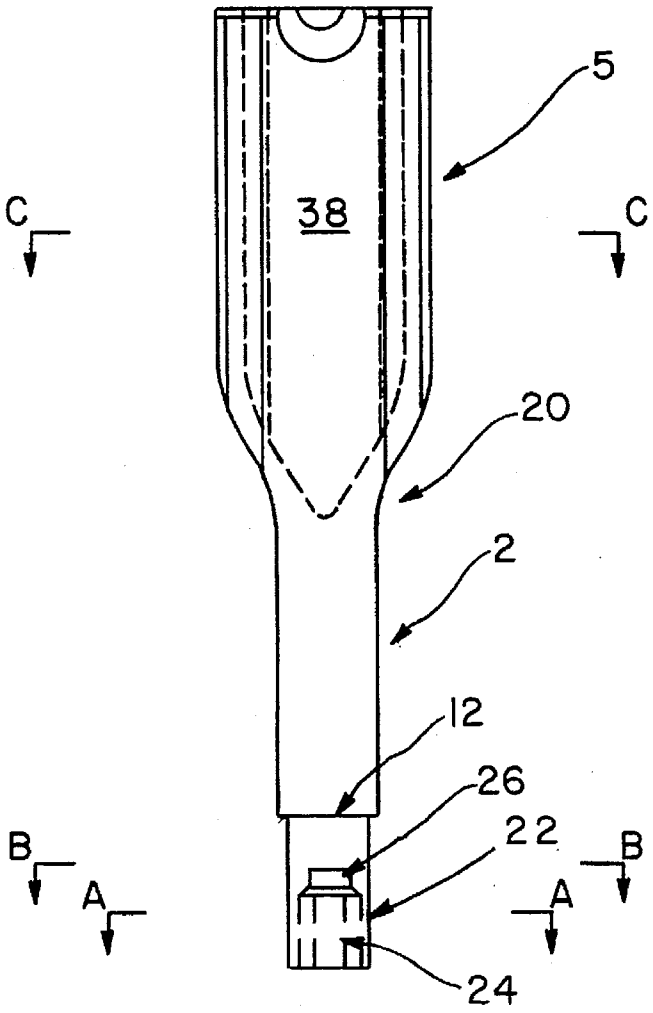
FIG. 3 is a side view of the handle and shaft of the driver of the present invention.
Figure 5:
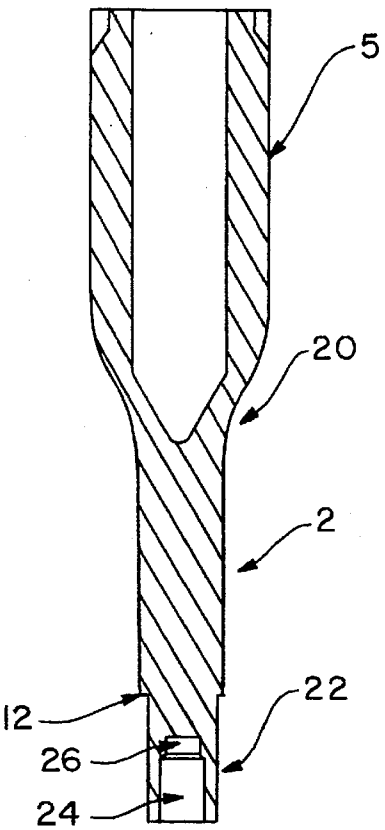
FIG. 5 is a cross-sectional view through Section E—E of FIG. 10.
Figure 8:
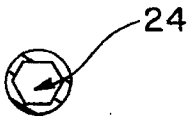
FIG. 8 is a cross-sectional view through Section A—A of FIG. 3.
Figure 6:
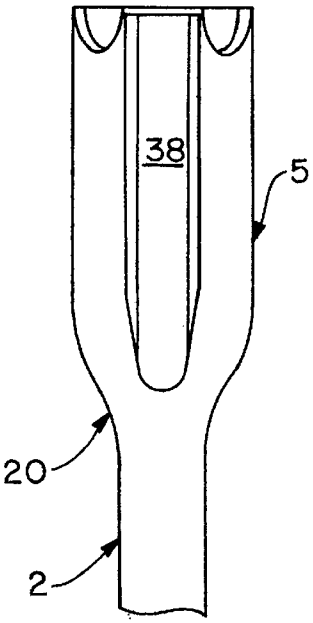
FIG. 6 is a partial side view of the handle and shaft of the invention from perspective "F" of FIG. 10.
Figure 7:
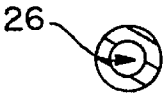
FIG. 7 is a cross-sectional view through Section B—B of FIG. 3.
Figure 9:
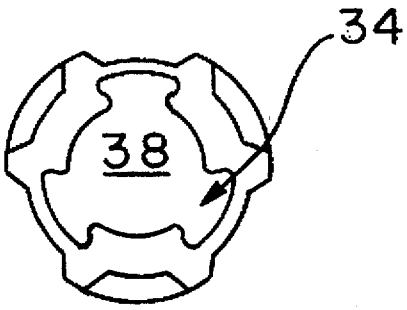
FIG. 9 is a top view of the invention as shown in FIG. 3.
Figure 10:
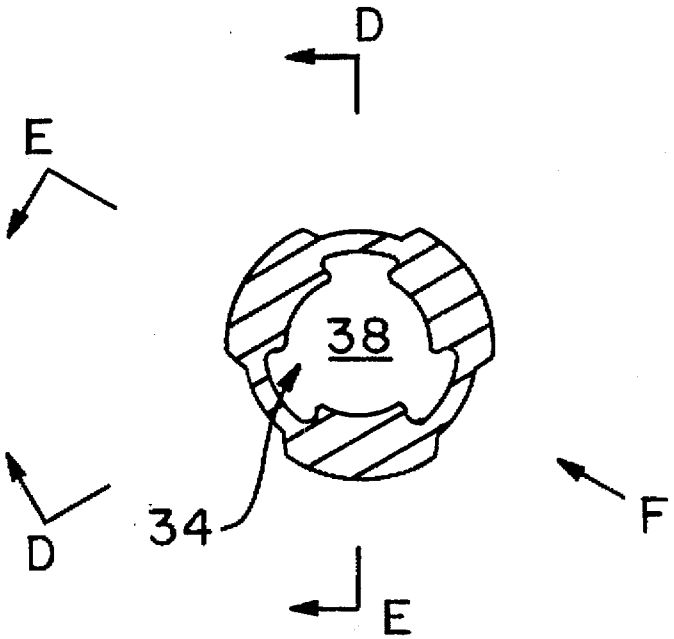
FIG. 10 is a cross-sectional view of the invention through Section C—C of FIG. 3.

As shown in FIGS. 1–10, the present invention is a hand-held driver which includes a handle (5) integrally molded with a shaft (2). The shaft (2) has a proximal end (20), which is attached to the handle, and a distal end (22) for receiving driving bits. Handle (5) is shaped like a conventional screwdriver handle for being gripped by a human hand, and may have a hollow interior which can be utilized for storage, if desired. In the alternative, the device may be manufactured with a solid handle.

Handle (5) is preferably constructed of a plastic material, preferably a glass-coupled acetal filled celcon, a glass-filled polycarbonate, or a reinforced molded resin. Shaft (2) is preferably integrally molded with handle (5) and is constructed of the same plastic material. As shown in FIGS. 1 and 3–5, the distal end (22) of shaft (2) is adapted to receive a conventional driving bit (10). This end includes a hexagonal cutout (24) to receive conventional driving bits, such as screwdriver or nut-driver bits.

Located adjacent to the hexagonal cutout is a magnet cutout (26) in which a magnet (8) is mounted for magnetizing and holding driving bit (10). Magnet (8) enables driving bit (10) to hold screws and other fasteners, and is preferably a conventional rare earth magnet. It will be appreciated that magnet (8) is an optional feature of the invention.

A retaining ring or ferrule (28) circumferentially surrounds the distal end (22) of the shaft (2) at the portion of the distal end which includes hexagonal cutout (24). The diameter of the shaft at the driving end (22) is narrowed so as to form a lip (12) for enabling the retaining ring (28) to be secured thereon while not increasing the diameter of the shaft. Of course, the diameter of the shaft (2) could be continuous, with the retaining ring (28) then extending slightly outward from the shaft. The retaining ring (28) is closely toleranced to the outer diameter of the shaft and circumferentially surrounds the driving end (22) to prevent the driving end from cracking, breaking or stripping when subject to torque during use of the device. The retaining ring preferably extends above the portion of the shaft cutaway for the magnet and bit so as to provide additional strength and to reduce the likelihood of fracturing the plastic.

Retaining ring (28) includes a hexagonal cutout (100) also sized to receive conventional driving bits. The hexagonal cutout (100) is aligned with the hexagonal cutout of the shaft to enable the bits to be inserted into the shaft. The hexagonal cutout (100) on the retaining ring serves dual functions. First, it prevents the plastic material of the shaft from becoming distorted, i.e., squeezed out of shape due to the force between the bit and the retaining ring as torque is applied to the bit, which could result in fracturing of the plastic. Second, a portion of the driving force is absorbed by the hexagonal portion of the retaining ring, which also reduces the likelihood that the plastic will fracture.

Retaining ring (28) is preferably constructed of stainless steel, or any other metal of sufficient strength. It will be appreciated that the function of the retaining ring (28) is to prevent outward movement of the softer material which forms the driving end. Consequently, any suitable material which accomplishes this function may be used in lieu of stainless-steel.

In order to utilize the driver, a driving bit is inserted in the cutout (24) of the driving end (22). The device may then be used as a conventional driver. When torque is applied to the driving end (22), the retaining ring (28) prevents the driving bit (10) from stripping the plastic material of the driving end or otherwise breaking the end of the tool.

The function performed by the retaining ring may be adapted to power tools as well as hand tools. In this embodiment, a shaft has a first end for connection to a drive means for causing rotation of the shaft, and a second end distal from the first end comprises a recess sized and shaped to enable the driving bits to be insertable therein and removable therefrom. The invention is generally applicable to enable softer materials, including plastics, and die-cast and extruded metals to be used in tool construction by simply providing a high-strength retaining ring over the driving end of the tool. The invention also permits the handle and shaft of a driver to be integrally molded from an inexpensive plastic material. In addition to being less expensive to manufacture, a plastic driver is preferable for use in electrical work, since the plastic is electrically non-conductive.

Figure 11:
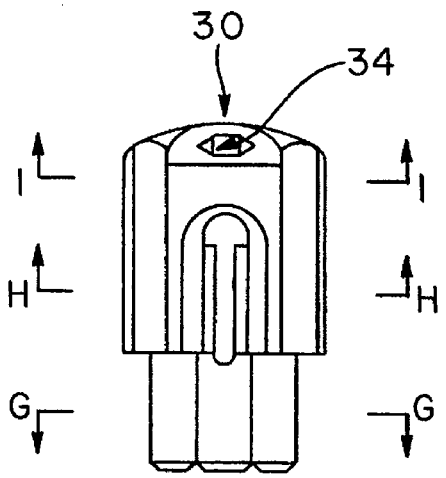
FIG. 11 is a side view of one embodiment of the bit-storing cap of the invention.
Figure 14:
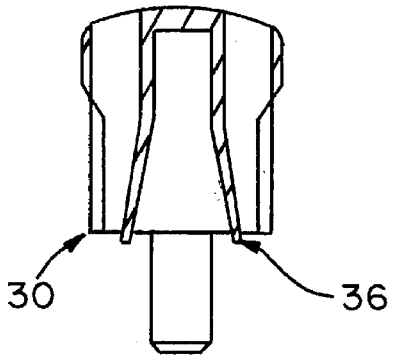
FIG. 14 is a cross-sectional view of the cap through Section K—K of FIG. 15.
Figure 12:
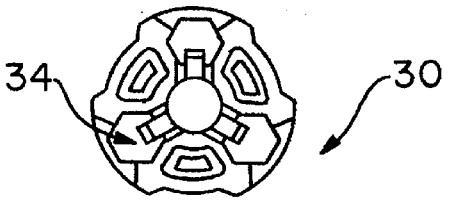
FIG. 12 is a bottom view of the cap shown in FIG. 11.
Figure 13:
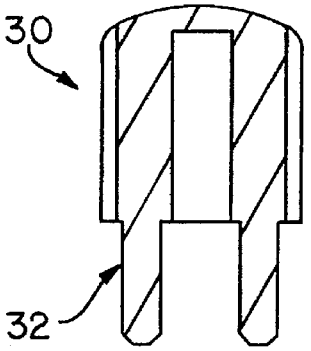
FIG. 13 is a cross-sectional view of the cap through Section J—J of FIG. 15.
Figure 17:
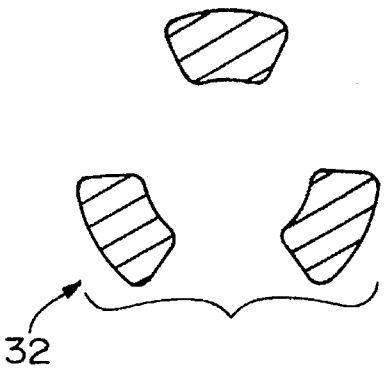
FIG. 17 is a cross-sectional view (scaled 2:1) of the cap through Section G—G of FIG. 11.
Figure 15:
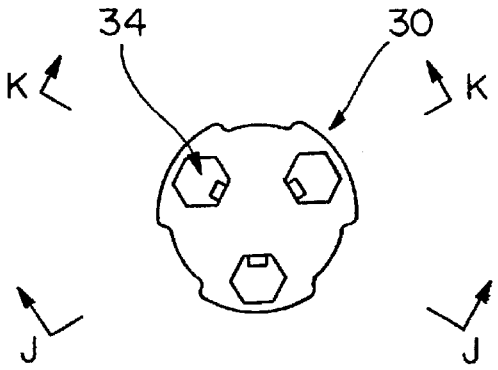
FIG. 15 is a top view of the bit-storing cap shown in FIG. 11.
Figure 16:
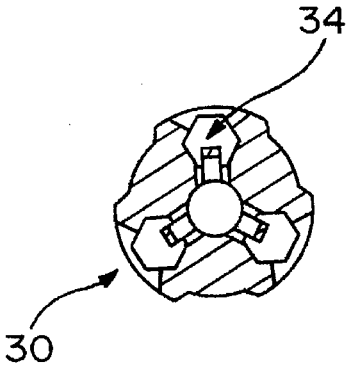
FIG. 16 is a cross-sectional view of the cap through Section H—H of FIG. 11.
Figure 18:
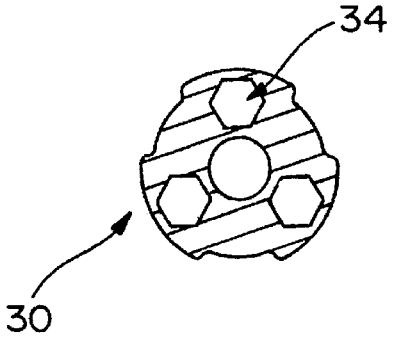
FIG. 18 is a cross-sectional view of the cap through Section I—I of FIG. 11.
Figure 19:
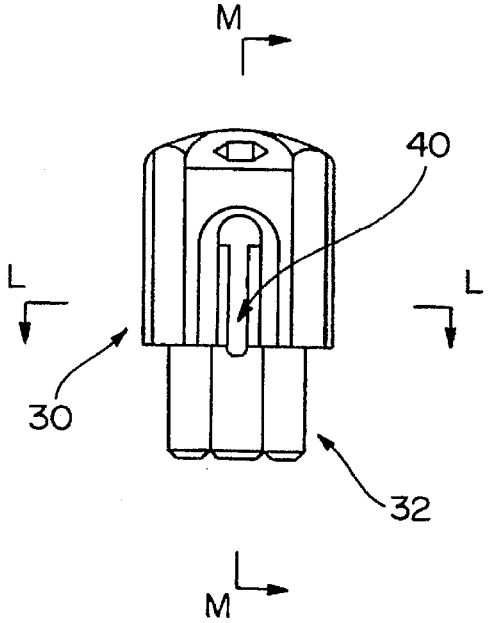
FIG. 19 is a side view of an alternative embodiment of a bit-storing cap.
Figure 21:
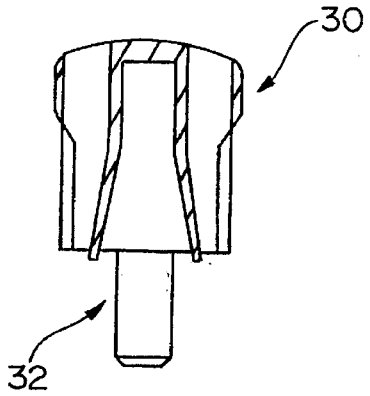
FIG. 21 is a cross-sectional view through Section M—M of FIG. 19.
Figure 22:
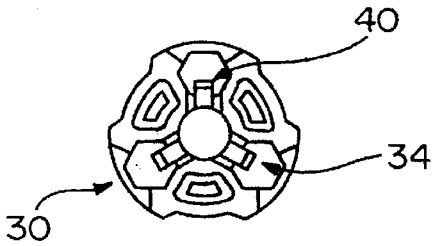
FIG. 22 is a bottom view of the cap shown in FIG. 19.
Figure 20:
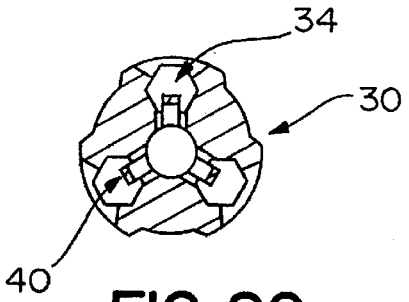
FIG. 20 is a cross-sectional view through Section L—L of FIG. 19.
Figure 24:
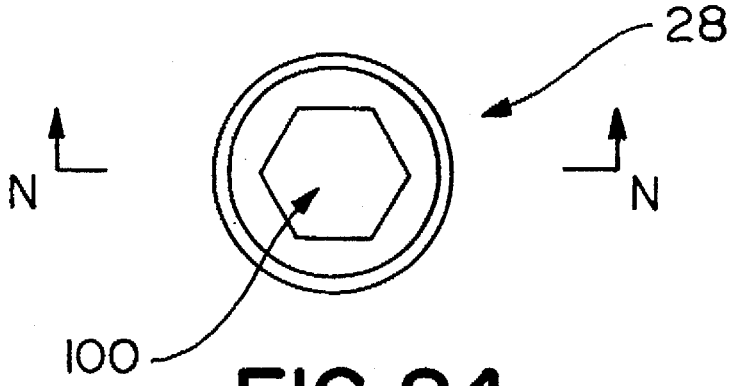
FIG. 24 is a top view of the ferrule shown in FIG. 23.
Figure 23:
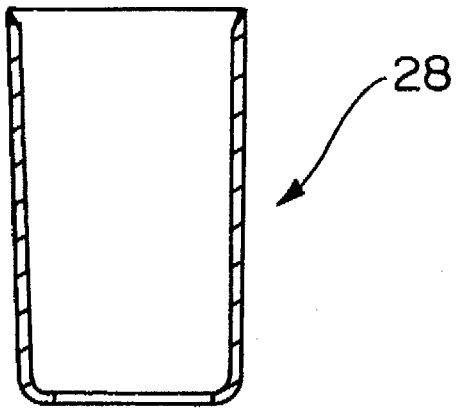
FIG. 23 is a cross-sectional view of the retaining ring or ferrule through Section N—N of FIG. 24.

As shown in FIGS. 11–22, a storage cap (30) is provided for being inserted into the top end of handle (5). Storage cap (30) is preferably constructed of a resilient plastic, rubber or other resilient material. Cap (30) includes resilient legs (32) which correspond with grooves (34) in handle (5) for enabling the cap to be properly inserted into the handle. A plurality of hexagonal slots (34), preferably three, are provided at the top of the cap for enabling the bits (10) to be stored therein. For each of the slots, a resilient arm (36) is provided which extends into the hexagonal slot (34). When a bit is inserted into the hexagonal slot (34), the resilient arm (36) applies pressure against the bit (10) to prevent the bit from sliding out of the slot. Handle (5) and cap (30) are shaped appropriately so that when the cap is inserted into the handle, it will be firmly retained therein. If desired, the hollow interior (38) of handle (5) maybe used for additional storage. In this instance, the cap maybe firmly secured to, but removable from, the handle (5). Resilient arms (36) are preferably integrally molded with the cap (30) to reduce manufacturing costs. It will be appreciated that any appropriate plastic material maybe used for the cap provided that the resilient arms perform the function indicated above.

In an alternative embodiment shown in FIGS. 19–22, in lieu of the resilient arms (36), one or more ridges (40) may be molded with the cap. The ridges (40) extend slightly into the hexagonal cutout (34), whereby when a bit is inserted into the cutout (34), ridges (40) provide sufficient frictional force for holding the bit (40) within the cutout while enabling removal of the bit without undue force. Thus, the present invention enables the construction of a one-piece cap for storing bits, including means for retaining the bits within the cap.

Figure 26:
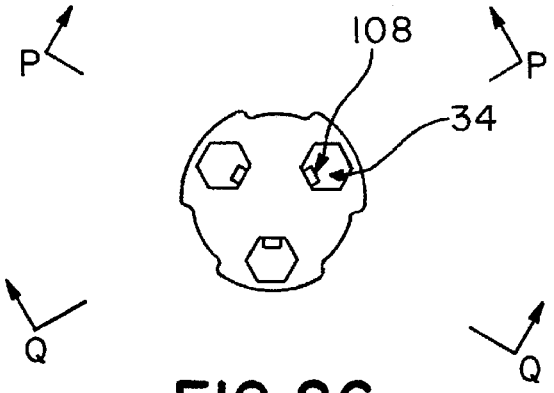
FIG. 26 is a top view of the alternative embodiment of the bit-storing cap shown in FIG. 25.
Figure 25:
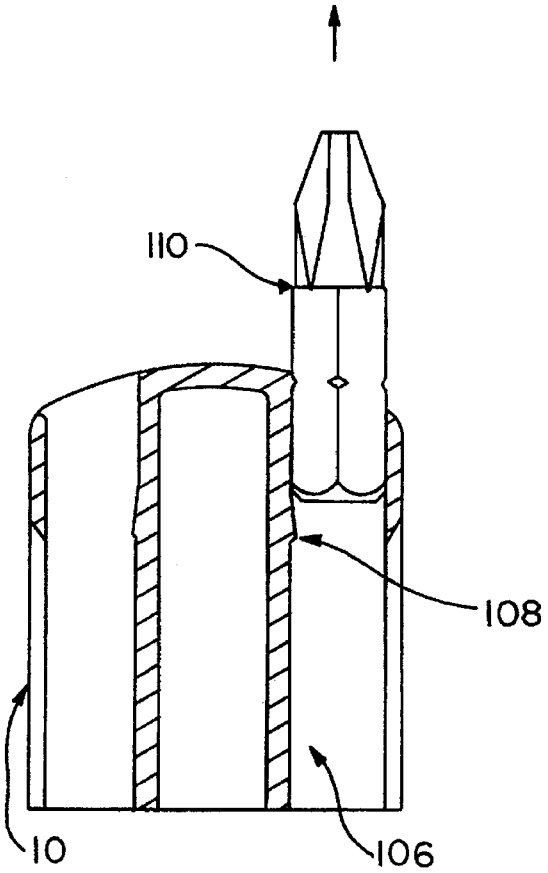
FIG. 25 is a cross-sectional side view of an alternative embodiment of the bit-storing cap.
Figure 27:
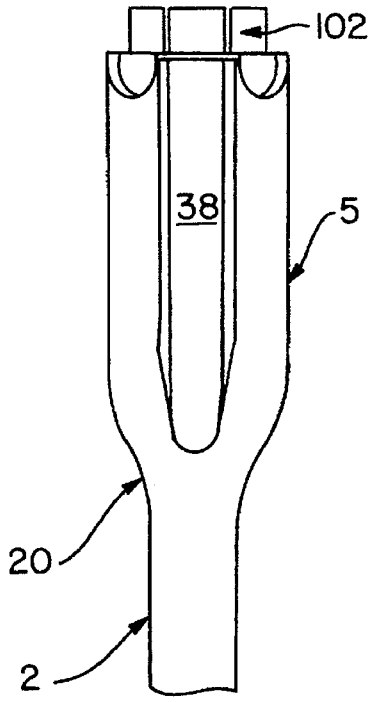
FIG. 27 is a is a partial side view of the handle and shaft of the invention from perspective "R" of FIG. 26.
Figure 29:
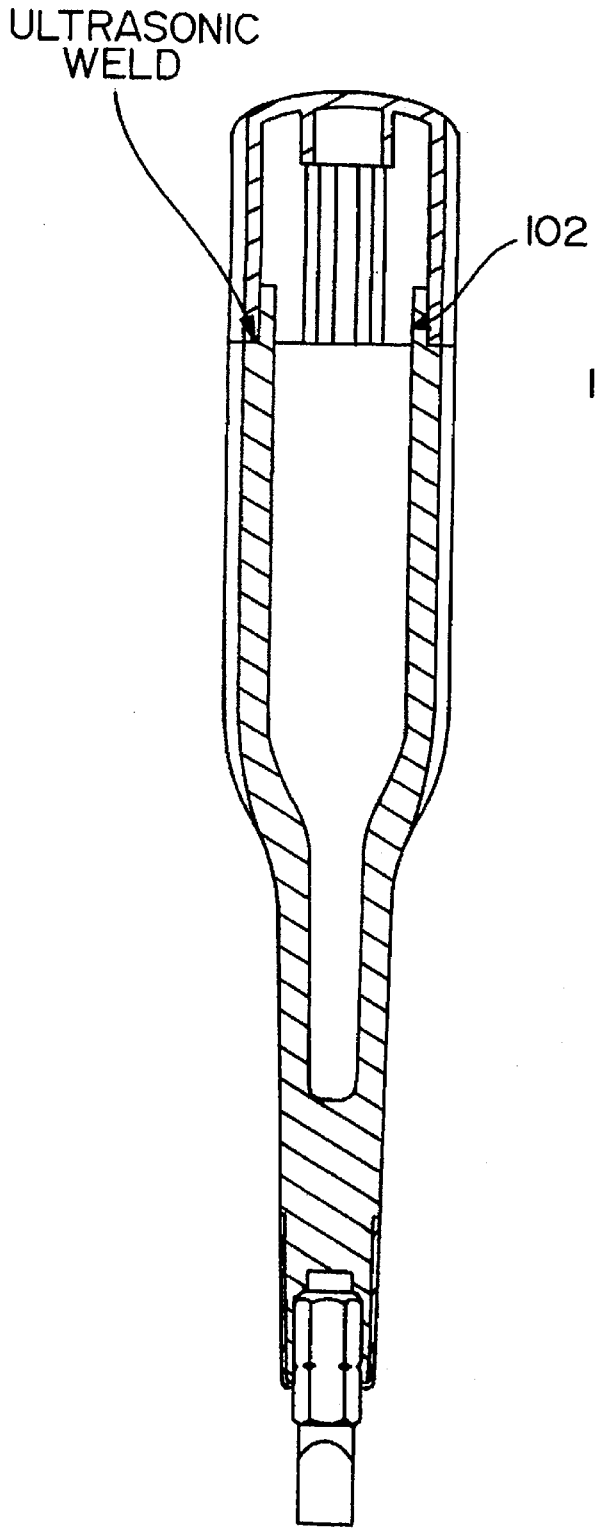
FIG. 29 is a cross-sectional view of the invention through Section Q—Q of FIG. 26.
Figure 28:
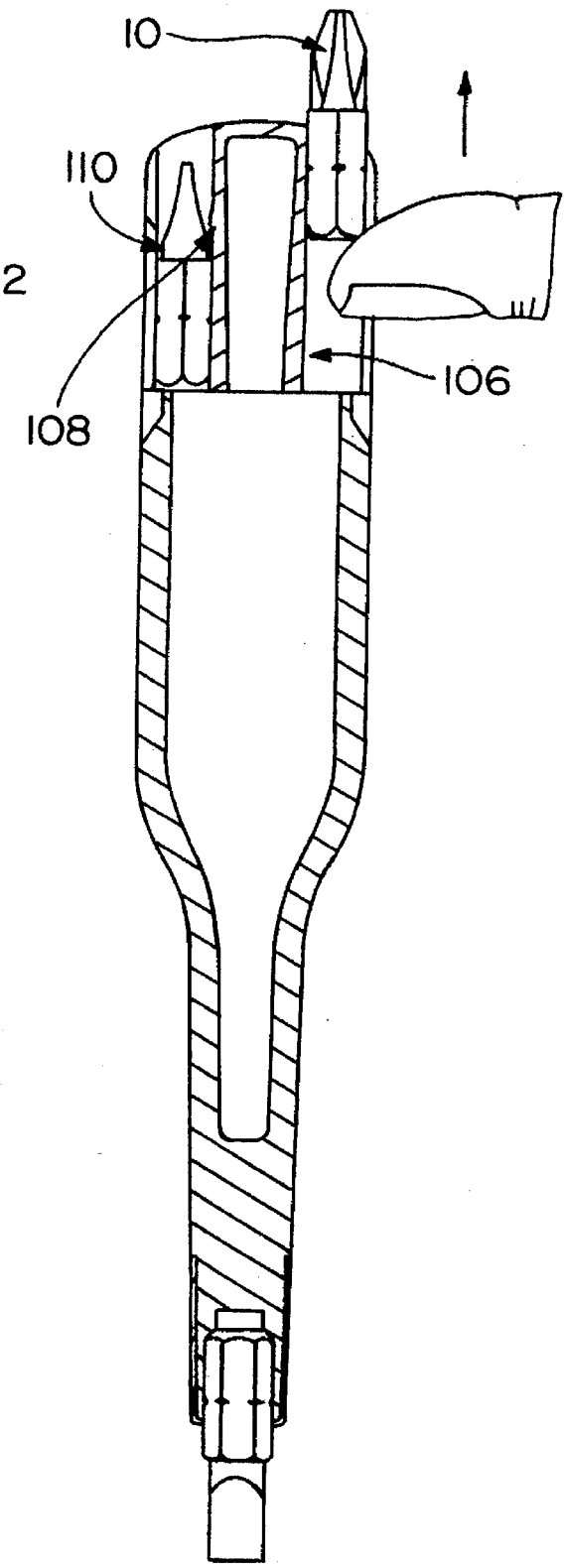
FIG. 28 is a cross-sectional view of the invention through Section P—P of FIG. 26.

In a still further alternative embodiment, as shown in FIGS. 25–29, handle (5) includes resilient legs (102) for enabling the handle to be slidably inserted into the cap. Storage cap (30) is preferably constructed of the same material as handle (5), such as a resilient material, and ultrasonically welded, glued or affixed thereto by any conventionally known means.

As before, a plurality of hexagonal slots (34), are provided at the top of the cap for enabling bits (10) to be stored therein. For each of the slots, a resilient arm (106) is provided which extends generally parallel to hexagonal slot (34). Each resilient arm (106) includes a nub or protuberance (108) which extends slightly into hexagonal slot (34). When a bit is inserted into hexagonal slot (34), the bit applies pressure against nub (108), thereby biasing resilient arm (106) sufficiently to enable bit (10) to slide past nub (108). Once bit (10) is fully inserted into the slot, resilient arm (106) relaxes, causing nub (108) to slightly block the hexagonal slot. Nub (108) interacts with a shoulder (110) of bit (10) to prevent the bit from sliding out of the slot. Because the resilient arm returns to its relaxed position once a bit is inserted into the slot, any tendency of the resilient arm to lose its biasing force for holding bits in the slot is eliminated.

Although the present invention has been described in detail with respect to certain embodiments and examples, variations and modifications exist which are within the scope of the present invention as defined in the following claims.

What is claimed is:

1. A driver for use with removable driving bits, the driver comprising:

a handle adapted to be hand-held;

a non-metallic shaft having a proximal end secured to the handle, and a distal end, the distal end of the shaft having an outer diameter and comprising a polygonal recess sized and shaped to enable a driving bit to be insertable therein and removable therefrom with a driving end of the driving bit extending from the distal end of the shaft; and a retaining ring or receiving a rotational driving force, the retaining ring circumferentially surrounding the shaft toward the distal end, the retaining ring closely sized to the outer diameter of the distal end of the shaft and secured thereto in fixed relation, the retaining ring comprising an open end adjacent to the distal end of the shaft having a size and shape corresponding to and aligned with the recess for receiving a rotational driving force from a driving bit inserted into the recess.

2. The driver according to claim 1 wherein the shaft is constructed of a thermoplastic.

3. The driver according to claim 1 wherein the handle and shaft are each constructed of a thermoplastic, and wherein the handle and shaft are integrally constructed.

4. The driver according to claim 1 wherein the retaining ring is constructed of a metal or high tensile strength material.

5. The driver according to claim 3 wherein the retaining ring is constructed of a metal or high tensile strength material.

6. The driver according to claim 1 further comprising:

one or more bit-receiving slots in the handle, each slot sized for enabling a driving bit to be slidably insertable therein and removable therefrom, each slot further comprising resilient means integrally molded with the handle for providing frictional resistance to movement of the bit within the slot, whereby the resilient means prevents the bit from falling out of the slot while enabling insertion and removal of bits from the slot.

7. The driver according to claim 6 wherein the handle comprises first and second portions adapted to be separably fitted together, the first portion attaching the handle to the shaft, the second portion comprising the bit-receiving slots.

8. The driver according to claim 7 wherein the handle and shaft are each constructed of a thermoplastic, and wherein the first portion of the handle and the shaft are integrally constructed.

9. The driver according to claim 6 wherein the resilient means comprises a nub extending into the slot, the resilient arm returning to a relaxed position once a bit is inserted into or removed from the slot.

10. An apparatus for removably receiving driving bits for enabling the insertion and removal of fasteners, the apparatus comprising:

a non-metallic shaft having a first end for connection to a drive means for causing rotation of the shaft, and a second end distal from the first end, the second end of the shaft comprising a polygonal recess sized and shaped to enable the driving bits to be insertable therein and removable therefrom with a driving end of the driving bit extending from the second end of the shaft; and a retaining ring for receiving a rotational driving force, the retaining ring circumferentially surrounding the shaft toward the second end and closely sized to the outer diameter thereof, the retaining ring comprising an open end adjacent to the second end of the shaft having a size and shape corresponding to and aligned with the recess or receiving a rotational driving force from a driving bit inserted into the recess, the retaining ring secured to the second end of the shaft in fixed relation thereto.

11. The apparatus according to claim 10 wherein the drive means is a handle for operation by a human hand, and wherein the handle and shaft are integrally molded of a thermoplastic.

12. A bit-storing handle for a driving apparatus, the handle constructed of a thermoplastic material and comprising:

one or more bit-receiving slots, each slot sized for enabling a driving bit to be slidably insertable therein and removable therefrom, each slot further comprising a resilient arm integrally molded with the handle for providing frictional resistance to movement of the bit within the slot, each resilient arm comprising nub means that extends into the slot, the nub means contacting the bit and biasing the resilient arm as the bit is inserted into and removed from the slot, the resilient arm returning to a relaxed position after the insertion or removal of the bit, the nub means cooperating with a shoulder of the bit for securing the bit in the slot.

13. The driver according to claim 1 wherein the recess has a depth, and wherein the retaining ring is sized to extend from the distal end toward the proximal end beyond the depth of the recess.

* * * * *

UNITED STATES PATENT AND TRADEMARK OFFICE

CERTIFICATE OF CORRECTION

PATENT NO. : 5,638,727

DATED : June 17, 1997

INVENTOR(S) : Donald Gringer

It is certified that error appears in the above-indentified patent and that said Letters Patent is hereby corrected as shown below:

| | | | |
|---|---|---|---|
| Column: 6 | Line: 12 | Delete: "or" | Insert: --for-- |
| Column: 7 | Line: 4 | Delete: "or" | Insert: --for-- |

Signed and Sealed this

Twenty-first Day of October 1997

*Attest:*

*Attesting Officer*

BRUCE LEHMAN

*Commissioner of Patents and Trademarks*